United States Patent [19]

Hesse

[11] Patent Number: 4,892,502

[45] Date of Patent: Jan. 9, 1990

[54] TOY VEHICLE WITH OWN MOTOR DRIVE

[76] Inventor: Kurt Hesse, Waldstrasse 36, D-8510 Fürth, Fed. Rep. of Germany

[21] Appl. No.: 116,564

[22] PCT Filed: Nov. 25, 1986

[86] PCT No.: PCT/DE86/00447

§ 371 Date: Sep. 17, 1987

§ 102(e) Date: Sep. 17, 1987

[87] PCT Pub. No.: WO87/04362

PCT Pub. Date: Jul. 30, 1987

[30] Foreign Application Priority Data

Jan. 27, 1986 [DE] Fed. Rep. of Germany ..... 3602349

[51] Int. Cl.[4] ..... A63H 17/26

[52] U.S. Cl. ..... 446/454; 446/444; 446/465; 273/86 B

[58] Field of Search ..... 446/462, 464, 465, 466, 446/469, 434, 444, 445, 446, 454, 455; 273/86 R, 86 B

[56] References Cited

U.S. PATENT DOCUMENTS

| | | | |
|---|---|---|---|
| 2,216,497 | 10/1940 | McHenry | 446/466 |
| 2,380,174 | 7/1945 | Haselton | 446/466 |
| 2,703,534 | 3/1955 | Copeland | 104/140 |
| 3,016,024 | 1/1962 | Silver . | |
| 3,083,500 | 4/1963 | Balthazor | 446/466 |
| 3,162,978 | 12/1964 | Balthazor | 446/466 |
| 3,205,616 | 9/1985 | Nisperly | 446/466 |
| 3,407,533 | 10/1968 | Hughes . | |

FOREIGN PATENT DOCUMENTS 28364 3/1947 Luxembourg .

*Primary Examiner*—Robert A. Hafer
*Assistant Examiner*—Sam Rimell
*Attorney, Agent, or Firm*—Collard, Roe & Galano

[57] ABSTRACT

In a toy vehicle with its own motor drive, in particular a toy vehicle for toy race track systems with a a pair of front wheels and a pair of rear wheels arranged on an undercarriage and a vehicle superstructure connected with the undercarriage, provision is made for two axially arranged undercarriage parts (2, 5) with a common plane of separation between the front wheels (6) and the rear wheels (3) for enhancing and maintaining the contact with trackways, such undercarriage parts being undisplaceably, but freely rotatably connected with one another by a connecting element. Furthermore, one part (2) of the undercarriage solidly engages the superstructure (1) of the vehicle and the other part (5) of the undercarriage is separated from the superstructure (1) of the vehicle.

3 Claims, 1 Drawing Sheet

TOY VEHICLE WITH OWN MOTOR DRIVE

The invention relates to a toy vehicle with its own motor drive, in particular for toy race track systems, with a pair of front wheels and a pair of rear wheels arranged on the undercarriage and a vehicle superstructure connected with the undercarriage.

It is known that undercarriages of toy vehicles are designed as one piece and, as a rule, solidly connected with the superstructure of the vehicle. In this way, the pairs of front and rear wheels supported in the undercarriage are rigidly kept in predetermined planes. When driving across winding or uneven segments of the trackway, the rigid arrangement of the front and rear wheels causes individual wheels to more or less lift from the segments of the trackway, which adversely affects the driving properties of the toy vehicle.

The objective of the invention is to implement measures for enhancing and maintaining the contact with the trackway of toy vehicles moving on trackways.

According to the invention, this objective is accomplished by two axially arranged parts of the undercarriage with a common plane of separation formed between the front and rear wheels, such parts being undisplaceably, but freely rotatably connected with each other by a connecting element, and in that one part of the undercarriage solidly engages the superstructure of the vehicle and the other part of the undercarriage is separated from the superstructure of the vehicle. In this way, the undercarriage of the vehicle can tilt over part of its length in either direction toward the one or other side and distortions of the raceway can be compensated. The swinging suspension of one pair of wheels, for example when driving through steep curves with an angle of gradient changing in the driving direction, prevents forces of torsion from adversely acting on the undercarriage or superstructure of the vehicle and assures safe adhesion of both pairs of wheels to the race track. In this way, steering and driving forces are safely transmittable to the segments of the raceway and good track-keeping is assured.

According to a preferred embodiment, the two parts of the undercarriage are freely rotatably connected with one another by means of an axle, which is fixed on the one part of the undercarriage and freely rotatable on the other part of the undercarriage while the axle permits free rotation between the front and rear parts of the undercarriage the connection prohibits displacement therebetween in the axial direction. Usefully, the axle is fixed on the rearward part of the undercarriage, which may be solidly connected with the superstructure of the vehicle, and freely engaging a receiving sleeve arranged on the front part of the undercarriage.

So as to accomplish in a simple manner an axial fixation of the swinging part of the undercarriage, the free end of the axle has a collar which, as an abutment, undisplaceably supports the rotating part of the undercarriage between itself and the rearward part of the undercarriage. Finally, provision is made to fix the axle on the one part of the undercarriage, in particular the rearward part, by means of screwed clamping rings, and to support the axle freely rotatable on the other part of the undercarriage by means of another clamping ring. The latter may embrace the axle with a small amount of clearance so as to permit smooth dip-nosing of the axle.

BRIEF DESCRIPTION OF THE DRAWING

The invention is explained in greater detail with the help of an embodiment shown by way of example in the drawing, in which:

In FIG. 1, reference numeral 1 denotes the body of a toy vehicle, which may have any desired design. An undercarriage part 2 is solidly connected with the body 1 and receives the pair of rear wheels 3 of the vehicle, which is drivable by an electric motor (not shown) by way of a shaft 4 supported in the part 2 of the undercarriage, such motor also being supported on the part 2 of the undercarriage. The undercarriage part 2 is axially associated with another independent undercarriage part 5 which, in the manner known, swingingly supports a pair of front wheels 6'. The undercarriage parts 2 and 5 are connected with one another by an axle 7, which is fixedly coupled to the undercarriage part 2 by means of a clamping ring 6, and rotatably supported in a clamping ring 8, the latter being connected with the undercarriage part 5 and acting in the manner of a sleeve joint allowing rotation between the clamping ring 8 and axle 7. Thus undercarriage part 5 may rotate about axlw 7 which is fixedly clamped in undercarriage part 2 by clamping ring 6. Collar 9 prevents the axial separation of undercarriage part 2 and 5 since it prevents axial movement of undercarriage part 5 along axle 7 while still allowing rotation therebetween. The axle 7 has a collar 9, which undisplaceably holds the undercarriage part 5 between itself and the undercarriage part 2. The clamping rings 6 and 8 are fixed on the undercarriage parts 2, 5 by the screws 10. Reference numeral 11 denotes current tappers which, when the toy vehicle is placed on the segments of the race track, interact in the manner known per se with current rails arranged in such segments. Furthermore, the undercarriage part 5 and the undercarriage part 2 each have a bridge 12 and 13, respectively, which bridges support holding elements 14 on their free ends and support the toy vehicle on the segments of the race track by means of lateral guide edges 16.

FIGS. 1 and 2 show that the undercarriage part 5 supporting the front wheels is tiltable downwardly to the left and right by degrees of angle, whereas the rearward undercarriage part 2 with the rear wheels and the body assumes, for example an upright position on the raceway.

Figure 3:
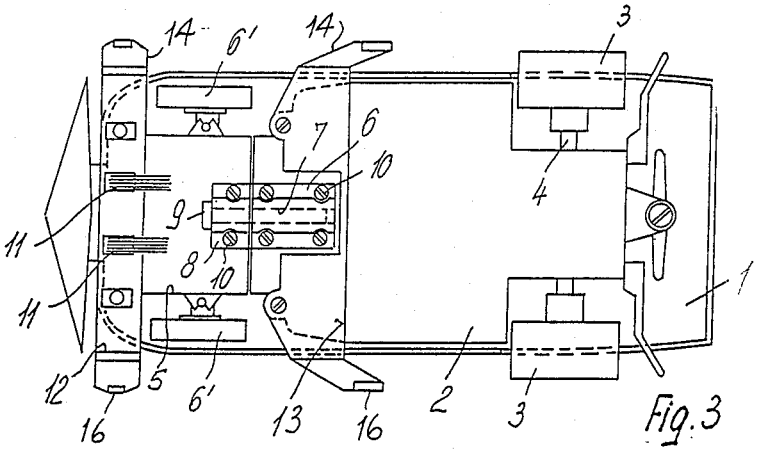
FIG. 3 shows a front view of a toy vehicle with front wheels tilted toward the other side.
Figure 1:
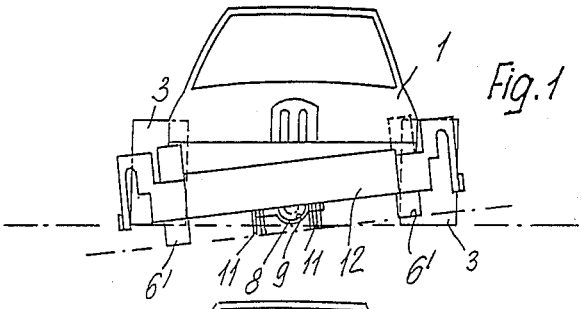
FIG. 1 shows a bottom view of a toy vehicle.
Figure 2:
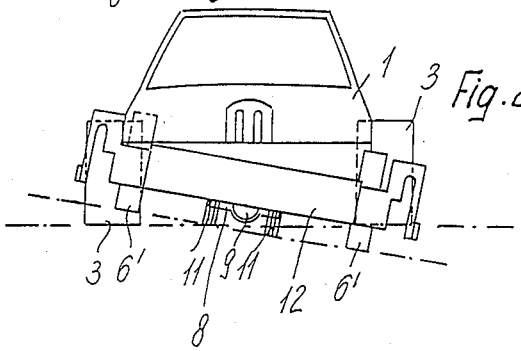
FIG. 2 shows a front view of a toy vehicle with front wheels tilted toward one side.

I claim:

1. An improved toy vehicle driven by a motor thereon particularly a toy car for toy race track systems, having a front undercarriage part with front wheels and, separated therefrom, a rear undercarriage part with back wheels, and having a vehicle assembly placed above both undercarriage parts and tightly gripping the rear undercarriage part, the front undercarriage part being arranged separately from the vehicle assembly, the improved toy vehicle is also provided with a swivel axle positioned in parallel with respect to the longitudinal vehicle axis in the area between the front and back wheels, the axle serving to pivotably interconnect the front and back undercarriage parts relative to each other, wherein the improvement comprises:

the swivel axle having one end fixed on the rear undercarriage part and an opposite end extending into and rotatably supported by a clamping ring positioned on the front undercarriage part, said opposite end of the axle which is rotatable with respect to the front undercarriage part has a collar permanently fixedly attached to said opposite end, which collar acts as an abutment to prevent axial movement of the freely rotatable front undercarriage part between the fixed rear undercarriage part and collar in the axial direction;

a bridge fixedly mounted on each of the front and rear undercarriage parts, each of said bridges having a pair of free ends; and, holding elements having lateral guide edges supporting the toy vehicle on the race track mounted on each free end of said bridges.

2. The improved toy vehicle, as set forth in claim 1, wherein the movable front undercarriage part carries current tappers for powering the motor thereon.

3. The improved toy vehicle, as set forth in claim 1, wherein the common junction of both undercarriage parts lies in a plane behind front wheels.

* * * * *